US008827273B2

(12) United States Patent
John et al.

(10) Patent No.: US 8,827,273 B2
(45) Date of Patent: Sep. 9, 2014

(54) CLEARING TRAP

(75) Inventors: Ernie John, American Fork, UT (US); David Bassett, Provo, UT (US); Chris Ream, Orem, UT (US); Mike Long, Fountain Green, UT (US); Nate Ralsor, Provo, UT (US)

(73) Assignee: Action Target Inc., Provo, UT (US)

( * ) Notice: Subject to any disclaimer, the term of this patent is extended or adjusted under 35 U.S.C. 154(b) by 459 days.

(21) Appl. No.: 13/189,340

(22) Filed: Jul. 22, 2011

(65) Prior Publication Data

US 2012/0187631 A1 Jul. 26, 2012

Related U.S. Application Data

(60) Provisional application No. 61/369,979, filed on Aug. 2, 2010.

(51) Int. Cl.
*F41J 13/00* (2009.01)

(52) U.S. Cl.
CPC ..... *F41J 13/00* (2013.01)
USPC ..... 273/410

(58) Field of Classification Search
USPC ..... 273/373, 403–410
See application file for complete search history.

(56) References Cited

U.S. PATENT DOCUMENTS

| | | | |
|---|---|---|---|
| 197,398 | A | 11/1877 | O'Neil |
| 385,546 | A | 7/1888 | Decumbus |
| 570,820 | A | 11/1896 | Scratton |
| 694,581 | A | 3/1902 | Reichlin |
| 840,610 | A | 1/1907 | Easdale |
| 941,642 | A | 11/1909 | Maxim |
| 980,255 | A | 1/1911 | Herms et al. |
| 1,035,908 | A | 8/1912 | Richardson |
| 1,155,717 | A | 10/1915 | Fouts |
| 1,704,731 | A | 8/1929 | Bernhard |
| 1,728,046 | A | 9/1929 | Duerr |
| 1,767,248 | A | 6/1930 | Leach |
| 2,013,133 | A | 9/1935 | Caswell |
| 2,039,602 | A | 5/1936 | Leubbe |
| 2,054,665 | A | 9/1936 | Tracy |
| 2,201,527 | A | 5/1940 | Freeman |
| 2,350,827 | A | 6/1944 | Saulnier |

(Continued)

FOREIGN PATENT DOCUMENTS

| | | |
|---|---|---|
| DE | 20 21 170 | 11/1971 |
| DE | 32 12 781 | 10/1983 |

(Continued)

OTHER PUBLICATIONS

Caswell International Corp., Bullet Trap Design, Circa 2002.

(Continued)

*Primary Examiner* — Mark Graham
(74) *Attorney, Agent, or Firm* — Bateman IP

(57) ABSTRACT

A clearing trap for decelerating bullets including a housing and bullet deceleration material disposed within the housing. The bullet deceleration material may include a plurality of layers of rubber material and metal for safely decelerating a bullet. Further, the layers of rubber material may have different densities and different types of metal may be used to decelerate a bullet. The clearing trap may also include vent holes for dissipation of the force generated from discharging a firearm in the housing and diverters which channel vented gasses away from a shooter.

27 Claims, 10 Drawing Sheets

(56) References Cited

U.S. PATENT DOCUMENTS 2,411,026 A 11/1946 Conner et al.
2,420,304 A 5/1947 Diem
2,518,445 A 8/1950 Benson
2,535,280 A 12/1950 Gartrell
2,631,454 A 3/1953 Shepard et al.
2,670,959 A 3/1954 Broyles
2,713,262 A 7/1955 Webster
2,772,092 A 11/1956 Nikoden
3,233,904 A 2/1966 Gillam et al.
3,265,226 A 8/1966 Malcolm
3,278,667 A 10/1966 Knox
3,300,032 A 1/1967 Lucien
3,323,800 A 6/1967 Knight
3,404,887 A 10/1968 Dundr
3,447,806 A 6/1969 Pfaff et al.
3,508,302 A 4/1970 Settanni
3,567,223 A 3/1971 Gentiluomo
3,673,294 A 6/1972 Matthaei
3,701,532 A 10/1972 Nikoden
3,720,411 A * 3/1973 DeVogelaere ..... 273/404
3,737,165 A 6/1973 Pencyla
3,982,761 A 9/1976 DeVogelaere
4,126,311 A 11/1978 Wagoner
4,272,078 A 6/1981 Vinette
4,317,572 A 3/1982 Iseli
4,445,693 A 5/1984 Angwin
4,458,901 A 7/1984 Wojcinski
4,479,048 A 10/1984 Kinoshita
4,509,301 A 4/1985 Head
4,512,585 A 4/1985 Baravaglio
4,589,792 A 5/1986 Niziol
4,638,546 A 1/1987 Benshoof
4,677,798 A 7/1987 Phillips
4,683,688 A 8/1987 Wojcinski
4,706,963 A 11/1987 Geuss
4,717,308 A 1/1988 Kuhns
4,728,109 A 3/1988 Simonetti
4,743,032 A 5/1988 Summers et al.
4,786,059 A 11/1988 Barini
4,787,289 A 11/1988 Duer
4,819,946 A 4/1989 Kahler
4,821,620 A 4/1989 Cartee et al.
4,846,043 A 7/1989 Langsam
4,856,791 A 8/1989 McQuade
4,890,847 A 1/1990 Cartee et al.
4,919,437 A 4/1990 Salabé et al.
4,953,875 A * 9/1990 Sudit ..... 273/373
5,006,995 A 4/1991 Toschi et al.
5,040,802 A 8/1991 Wojcinski et al.
5,070,763 A 12/1991 Coburn
5,085,765 A 2/1992 Salabé et al.
5,088,741 A 2/1992 Simonetti
5,113,700 A 5/1992 Coburn
5,121,671 A 6/1992 Coburn
D329,680 S 9/1992 Burn
5,163,689 A 11/1992 Bateman
5,171,020 A 12/1992 Wojcinski
5,213,336 A 5/1993 Bateman
5,232,227 A 8/1993 Bateman
5,240,258 A 8/1993 Bateman
5,242,172 A 9/1993 Bateman
5,255,924 A 10/1993 Copius
5,259,291 A 11/1993 Wilson
5,277,432 A 1/1994 Bateman
5,333,557 A 8/1994 Eickhoff
5,340,117 A 8/1994 Wojcinski
5,366,105 A * 11/1994 Kerman et al. ..... 220/62.11
5,367,860 A 11/1994 Cullen
5,400,692 A * 3/1995 Bateman ..... 273/410
5,405,673 A 4/1995 Seibert
5,435,571 A 7/1995 Wojcinski et al.
5,441,280 A 8/1995 Copius
5,443,352 A 8/1995 Schumacher
5,456,155 A 10/1995 Myrtoglou
5,486,008 A 1/1996 Coburn
5,535,662 A 7/1996 Bateman
5,542,616 A 8/1996 Archer
5,564,712 A 10/1996 Werner
5,607,163 A 3/1997 Nesler
5,618,044 A 4/1997 Bateman
5,655,775 A 8/1997 Pontus et al.
5,684,264 A * 11/1997 Cassells et al. ..... 89/1.1
5,715,739 A 2/1998 White
5,718,434 A 2/1998 Alward
5,738,593 A 4/1998 Coury et al.
5,749,177 A 5/1998 Pontus et al.
5,811,164 A 9/1998 Mitchell
5,811,718 A 9/1998 Bateman
5,822,936 A 10/1998 Bateman
5,848,794 A 12/1998 Wojcinski et al.
5,901,960 A 5/1999 Nesler et al.
5,951,016 A 9/1999 Bateman
5,988,647 A * 11/1999 Porter et al. ..... 273/410
6,000,700 A 12/1999 Nesler et al.
6,009,790 A 1/2000 Tekorius
6,016,735 A 1/2000 Langner
6,027,120 A 2/2000 Wojcinski et al.
6,162,057 A 12/2000 Westphal et al.
6,173,956 B1 1/2001 O'Neal
6,245,822 B1 6/2001 Terada et al.
6,268,590 B1 7/2001 Gale et al.
6,293,552 B1 9/2001 Wojcinski et al.
6,311,980 B1 11/2001 Sovine et al.
6,341,708 B1 1/2002 Palley et al.
6,350,197 B1 2/2002 Cooksey
6,363,867 B1 4/2002 Tsilevich
6,378,870 B1 4/2002 Sovine
6,415,557 B1 7/2002 McCalley
6,484,990 B1 11/2002 Marshall
6,533,280 B1 3/2003 Sovine et al.
6,588,759 B1 7/2003 Bateman
6,722,195 B2 * 4/2004 Duke ..... 73/167
6,732,628 B1 * 5/2004 Coburn et al. ..... 273/410
RE38,540 E 6/2004 Bateman
6,776,418 B1 8/2004 Sovine et al.
6,808,178 B1 10/2004 Sovine
6,910,254 B2 6/2005 Aoki et al.
6,975,859 B1 12/2005 Lambert et al.
6,994,347 B2 2/2006 Tessel et al.
6,994,348 B2 2/2006 Lambert et al.
6,994,349 B2 2/2006 Lambert et al.
7,140,615 B1 11/2006 Sovine et al.
7,175,181 B1 2/2007 Bateman et al.
7,194,944 B2 3/2007 Lambert et al.
7,219,897 B2 5/2007 Sovine et al.
7,234,890 B1 6/2007 Marshall et al.
7,264,246 B2 9/2007 Sovine et al.
7,275,748 B2 10/2007 Lambert et al.
7,303,192 B2 12/2007 Marshall et al.
7,306,230 B2 12/2007 Lambert et al.
7,322,771 B1 1/2008 Marshall et al.
7,427,069 B2 9/2008 Bateman et al.
7,431,302 B2 10/2008 Bassett et al.
7,469,903 B2 12/2008 Marshall et al.
7,503,250 B2 3/2009 Lambert et al.
7,556,268 B2 7/2009 Bateman et al.
7,653,979 B2 2/2010 Bateman et al.
7,775,526 B1 8/2010 Lambert et al.
7,793,937 B2 9/2010 Bateman et al.
8,313,103 B2 * 11/2012 O'Neal et al. ..... 273/410
2002/0088339 A1 * 7/2002 Koffler ..... 89/36.02
2005/0022658 A1 2/2005 Bateman et al.
2006/0234069 A1 10/2006 Sovine et al.
2006/0240388 A1 10/2006 Marshall et al.
2006/0240391 A1 10/2006 Sovine et al.
2007/0072537 A1 3/2007 Bateman et al.
2007/0102883 A1 5/2007 Parks et al.
2011/0037227 A1 2/2011 O'Neal et al.
2011/0062667 A1 * 3/2011 Medina et al. ..... 273/404

FOREIGN PATENT DOCUMENTS

DE 214 433 10/1984
DE 36 35 741 7/1992

(56) References Cited

FOREIGN PATENT DOCUMENTS

| | | | |
|---|---|---|---|
| EP | 0 399 960 | | 11/1990 |
| EP | 0 523 801 | | 1/1993 |
| EP | 0 528 722 | | 2/1993 |
| GB | 6353 | | 0/1909 |
| GB | 2 242 730 | | 10/1991 |
| JP | 05241275 | A | 9/1993 |
| JP | 10339093 | A | 12/1998 |
| WO | WO 85-05672 | | 12/1985 |
| WO | WO 94-27111 | | 11/1994 |

OTHER PUBLICATIONS

Caswell International Corp., Bullet Trap Product Literature, Circa 2002.

Caswell International Corp., Product Literature, Copyright 2002.

Declaration of Kyle Bateman re Bullet Trap Design Circa 2001.

Duelatron, Product Literature 1995.

www.letargets.com. Breach training door. Circa 2005.

www.mgmtargets.com. Breach training door Circa 2005.

Porta Target, Product Literature, Circa 2000.

Porta Target, Shoot House Product Literature, Circa 2000.

Savage Arms, Shoot House Bid and Specification, Bid dated Oct. 1998.

ST Bullet Containment Sytems, Inc. Product Literature, Circa 2002.

Trussed Concrete Steel Co., Youngstown, Ohio, Copyright 1903, Product Literature.

* cited by examiner

CLEARING TRAP

RELATED APPLICATIONS

The present application claims the benefit of U.S. Provisional Patent Application No. 61/369,979, filed Aug. 2, 2010, the entirety of which is hereby incorporated by reference.

BACKGROUND OF THE INVENTION

1. The Field of the Invention

The present invention relates to a device and method for decelerating projectiles. More specifically, the present invention relates to an improved clearing trap for decelerating projectiles discharged when performing a clearing check to ensure that the gun is empty.

2. State of the Art

In order to maintain proficiency in the use of firearms, it is common for law enforcement officers and sportsmen to engage in target practice. Participants will typically shoot at targets which are placed in front of some type of bullet containment system. After passing through the target, the bullet is typically contained in a trap where the bullet may be retrieved and recycled. Such traps include total containment systems wherein the bullet is received in a chamber, and less expensive berm traps in which the bullet is received by a bullet deceleration material.

A variety of devices to prevent accidental firing of a firearm, such as safety locks, are built into or used with handguns and rifles. Despite such safety features, accidental discharges do occur, most frequently during the loading or unloading of the firearm. While it is easy to remove a magazine or other container holding the bullets, it may be difficult to accurately determine if a bullet is contained in the chamber of the gun. Nevertheless, after a target shooter is finished it is usually a requirement that the weapon be unloaded for transportation and/or storage.

To prevent accidental discharges from occurring, it is common for the target shooter to use a clearing trap. A clearing trap is typically a small trap disposed near the main target range into which a gun is inserted and the trigger pulled. If the gun has been properly emptied, there will be no discharge and the user will be assured that the gun is empty. However, occasionally the gun will fire due to a round that was not properly removed from the chamber. Once the round is discharged, the user may pull the trigger again for assurance that the gun is empty. Once it is demonstrated that the gun is empty, the user may store or transport the gun.

Likewise, there are situations in which it is desirable to clear a weapon away from a traditional range setting. For example, police officers may use special weapons during certain types of situations, such a bank robberies or hostage situations. Because the weapons are not used on a regular basis, it is usually desirable to ensure that the weapon is not loaded when stored. Thus, for example, while an officer would typically not clear his or her service pistol, he or she may desire to clear a semi-automatic rifle when not in use.

Although clearing traps are currently available for this purpose, each has various limitations. For example, FIG. 1A shows a perspective view of a prior art clearing trap, generally indicated at 10. The clearing trap 10 has a cylindrical housing 14 which has a closed lower end 18 and an upper end 22 partially enclosed by a disk with an opening for receiving the barrel of a gun. The cylindrical housing may be held at an angle so that the user may hold the gun in a comfortable position while pulling the trigger. The cylindrical housing 14 is filled with sand to decelerate rounds which are fired therein.

When the housing 14 is sufficiently full of bullets, the housing is turned upside down and the contents removed.

The configuration shown has several disadvantages. For example, the housing 14 must be made either of specially formed steel plate (i.e. steel having a thickness of 0.25 inches), or of standard steel or some other material. Forming the steel plate into the cylindrical housing 14 can be expensive, and using standard steel raises the risk that the housing will become damaged if a user fires the gun at an angle significantly deviating from the long axis of the housing. Additionally, the sand in the housing 14 is heavy and inverting the housing for clearing can require significant effort.

FIG. 1B shows a side cross-sectional view of an alternate type of clearing trap, generally indicated at 30. The trap 30 uses a circular containment chamber 34 similar to that disclosed in U.S. Pat. Nos. 5,070,763; 5,113,700; 5,121,671; and 5,486,008. As the bullet moves through from the opening 38 through the circular containment chamber 34, the bullet is forced to travel in a circular pattern. While such movement is highly effective at decelerating the bullet, it can also cause lead dust to be released into the air. Additionally, the trap 30 is relatively expensive to make, as plate steel must be formed into the circular pattern and be disposed in a relatively large housing. Size is also a concern to obtain a reasonable radius of travel for the bullet.

FIG. 1C shows yet another trap, generally indicated at 50, which is used for clearing weapons. The trap has a housing 54 with an opening 58 for inserting a gun. Disposed within the housing 54 is a plurality of rubber sheets 60. As the bullet travels through the rubber sheets 60, the bullet is decelerated until it comes to a rest. While the sheets are effective at stopping the bullet and preventing fragmentation, over time they can develop large holes which reduce their ability to decelerate bullets.

Turning now to FIG. 1D, there is shown a side cross-sectional view of yet another clearing trap, generally indicated at 70, in accordance with the prior art. The clearing trap includes a housing 72 which is made of common steel. Inside the housing is a plurality of inserts made of rubber 74 and steel 76 which are designed to receive and decelerate a bullet. The housing 72 also includes a plurality of vent holes 77 for allowing gasses to escape. While the design is advantageous in that it is relatively compact and light weight, it also has disadvantages. For example, because the housing is made of common steel, a bullet ricocheting off the steel deceleration plates can potentially penetrate or at least deform the housing. For example, a .223 round was fired into the housing 72. The bullet ricocheted and caused a noticeable bulge in the housing. Additionally, an end cap 78 through which the gun is inserted blew off and hit the shooter in the face. Furthermore, in order to remove the bullet deceleration material, the top of the housing must be cut off, making frequent replacement of the deceleration material impractical.

Turning to FIG. 1E, there is shown a cross-sectional view of yet another clearing trap. The trap 80 includes a common steel outer housing 82 and a plurality of removable interlocking hardened steel plates 84 which can be removed from the housing. A bullet deceleration material 86 such as sand or chopped rubber can be disposed inside the plates to decelerate the bullet prior to impact with the plates. A removable end plate 88 attaches to a flange 90 and holds a shielding material 92 (i.e. rubber, etc.) through which the gun is inserted. Removal of the end plate 88 allows the plates 84 and deceleration material 86 to be removed for cleaning, etc.

The trap shown in FIG. 1E is effective at stopping rounds. However, it is relatively large and is generally not for use with high power rounds.

Thus, there is a need for an improved clearing trap and method for bullet deceleration which provides the advantages of prior art clearing traps without some or all of the disadvantages of the currently available systems. Such a system may be advantageous by stopping a wide variety of rounds in a compact space, and may be lightweight, relatively inexpensive and easy to use.

SUMMARY OF THE INVENTION

It is an object of the present invention to provide an improved clearing trap.

According to one aspect of the present invention, the clearing trap may be formed from a hardened steel housing and bullet deceleration material disposed within the housing. The hardened steel housing and the deceleration material allow a bullet to be safely contained in the housing in an improved manner over the prior art.

According to another aspect of the invention, the housing may be attached together with a plurality of welds in such a manner that none of the welds are directly exposed to a bullet fired into the clearing trap.

In accordance with another aspect of the invention, the bullet deceleration material uses pieces of rubber (or the like) and sheets of steel (which may include hardened steel) to decelerate the bullet and enables bullets to be contained in a smaller clearing trap for the size of the projectile than generally available.

According to another aspect of the present invention, the clearing trap may include one or more flanges extending from the housing with at least a portion of the flange being at an angle relative to the adjacent wall of the housing and adjacent a vent to shield the shooter or others nearby from vented gasses escaping from the housing. In a presently preferred embodiment, the flange(s) may be bent to form an angle greater than 90° relative to the adjacent wall of the housing and more preferably is generally L-shaped so that the flange channels gas escaping from the housing away from the shooter and generally parallel to the path of travel of a projectile discharged from a gun into the housing.

These and other aspects of the present invention may be realized in an improved clearing trap as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1A:
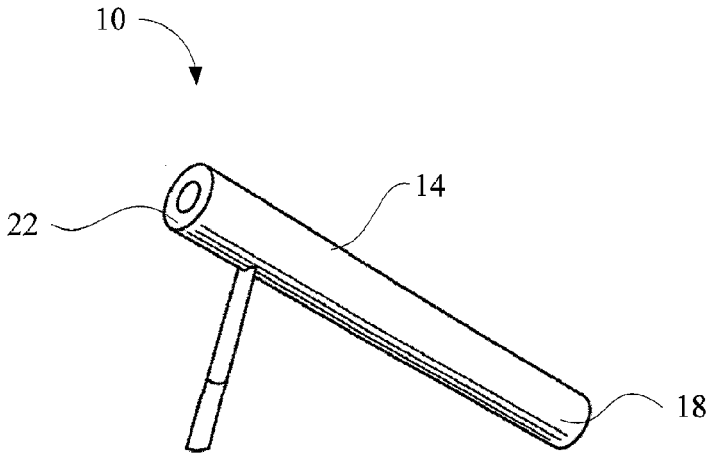
FIG. 1A (Prior Art)
FIG. 1A shows a side view of a clearing trap made in accordance with the prior art.
Figure 1B:
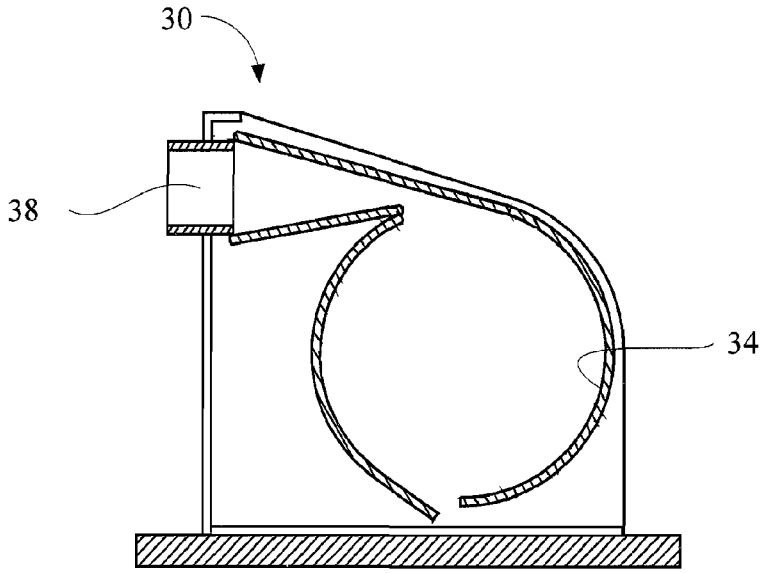
FIG. 1B (Prior Art)
FIG. 1B shows a side cross-sectional view of a clearing trap made in accordance with the teachings of the prior art.
Figure 1C:
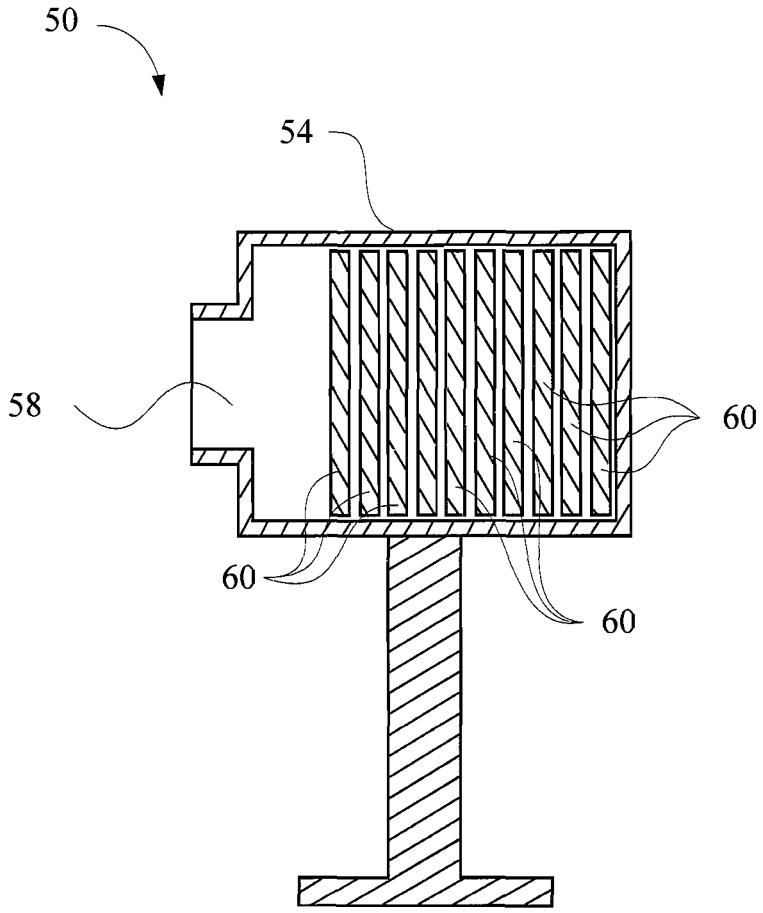
FIG. 1C (Prior Art)
FIG. 1C shows a side cross-sectional view of a clearing trap made in accordance with the teachings of the prior art.
Figure 1D:
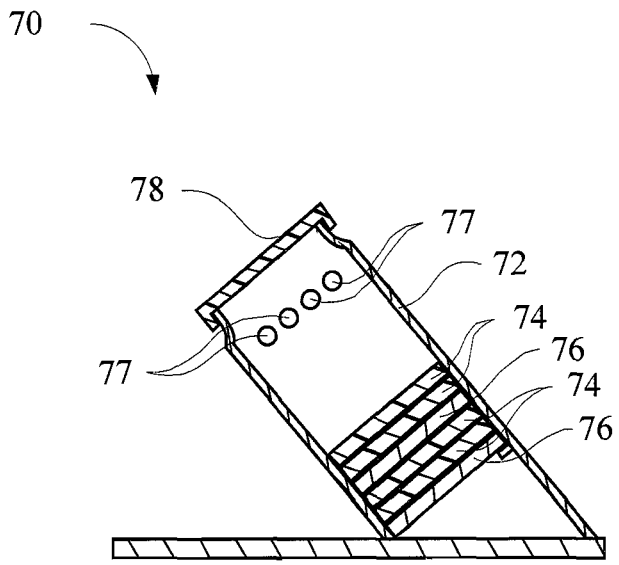
FIG. 1D (Prior Art)
FIG. 1D shows a side cross-sectional view of a clearing trap made in accordance with the teachings of the prior art.
Figure 1E:
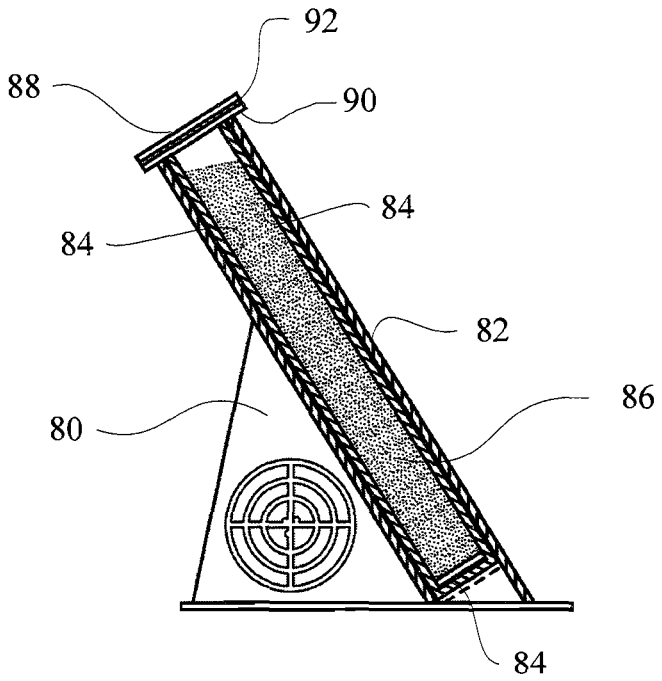
FIG. 1E (Prior Art)
FIG. 1E shows a side cross-sectional view of a clearing trap made in accordance with the teachings of the prior art.
Figure 2:
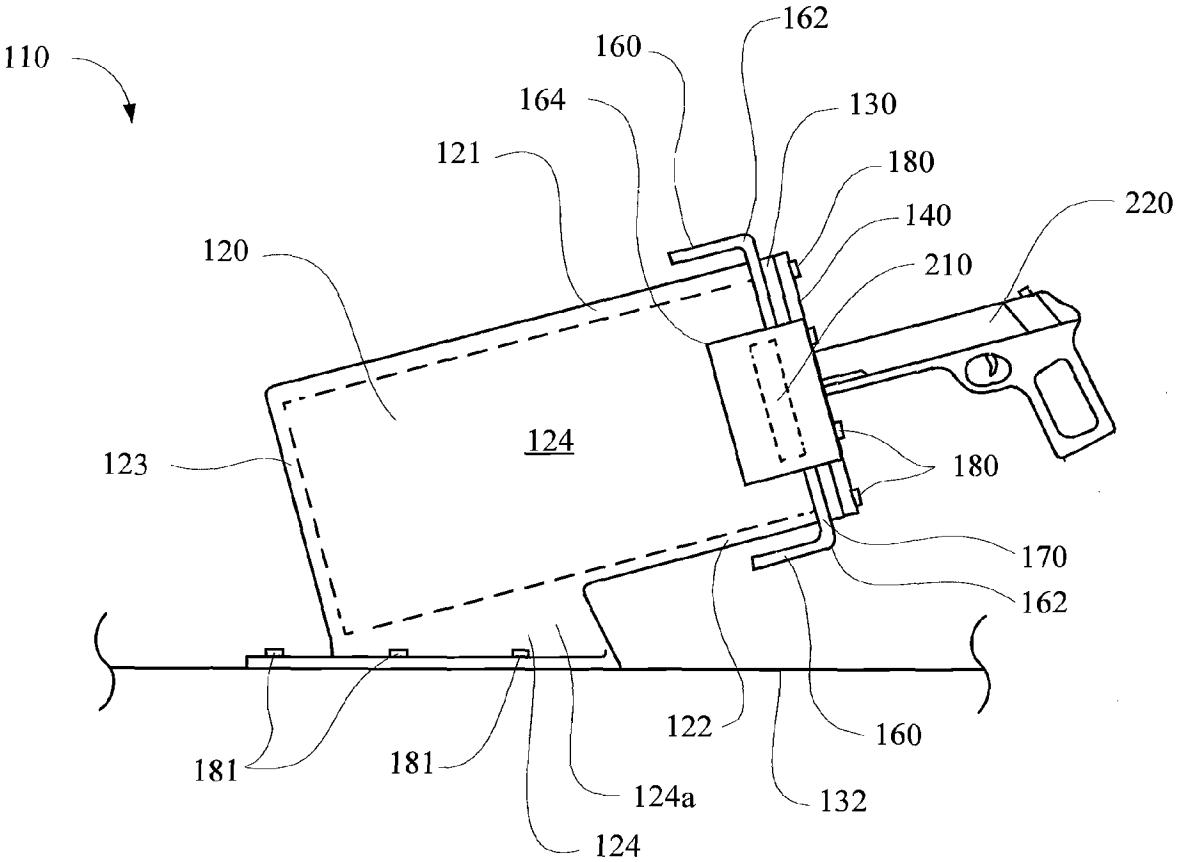
FIG. 2 shows a side view of a clearing trap made according to principles of the present invention.

Turning now to FIG. 2, there is shown a side view of a clearing trap, generally indicated at 110, made in accordance with principles of the present invention. The clearing trap 110 may include an elongate housing 120 into which a gun 220 may be inserted and the trigger pulled in order to ensure that the gun has been properly unloaded. The housing 120 may be formed of plate steel which is sufficiently thick to stop high-power firearm rounds, such as AR 500 or AR 550, although other hardened steels may be used. Each piece of steel forming the housing may be, for example, ⅜ to ¼ of an inch thick, although other thicknesses, such as ½ inch, etc., may be used.

The housing 120 may have a cavity defined by an outer wall and can be preformed in a desired shape, typically a square cross-section defined by two sidewalls 124 (only one of which is shown in FIG. 2), an upper wall 121, a lower wall 122, and a back wall 123. It should be appreciated that the housing 120 may be formed from materials, other than plate steel, that are efficient at stopping high-powered or other predetermined strength rounds.

One or more flanges 170 or other end pieces may be positioned adjacent the top of the housing 120 and may extend outwardly. Typically, the flange 170 may extend completely around the opening at the proximal end of the housing 120, though this is not required.

A containment shield 130 can be removably connected to the flange 170 to cover the open end of the housing 120. The containment shield 130 may have an opening for receiving the gun 220. The containment shield 130 may be made of a flexible material, such as rubber or LINATEX, available from Durex Products, Inc., Windfall, Ind. As is shown in FIG. 2, the containment shield 130 may be removably connected to flange 170 via a mounting plate 140. The mounting plate 140 may be bolted to the housing of the clearing trap, with the containment shield 130 located between the flange 170 and the mounting plate 140. Although bolts 180 are shown to removably attach the mounting plate 140 to flange 170 or to the housing 120, it should be appreciated that a variety of other fasteners may be used to removably attach the mounting plate, such as screws, rivets, etc.

The housing 120 may include a base portion 124A, which may be formed by a portion of the sidewalls 124. As shown in FIG. 2, the housing 120 may be formed with base 124A so as to dispose the housing at an angle relative to horizontal so that the user may maintain a comfortable position when performing the clearing check on the gun 220. The clearing trap 110 may be removably mounted to a horizontal surface 132, such as a table or bench, or other oriented surface, via base 124A.

As shown, bolts 181 may be used to mount clearing trap 110 to a surface 132, however, it will be appreciated that clearing trap 110 may be mounted to the surface 132 using a variety of other methods. Ordinary persons skilled in the art will also appreciate that housing 120 need not be preformed to include base 124A. Rather, housing 120 may be mounted to a variety of structures.

The flange 170 may include extensions or attachments which form diverters 160 which have a bend 162 so that the diverters 160 extend 90° or less relative to upper wall 121, sidewalls 124 and/or lower wall 122 adjacent to which they are disposed. Preferably, the diverters extend generally parallel to the walls to which they are adjacent, although other angles are satisfactory. Additionally and/or alternatively, diverters 164 may extend from the mounting plate 140 so as to extend adjacent to sidewalls 124, top wall 121 or bottom wall 122.

Figure 3:
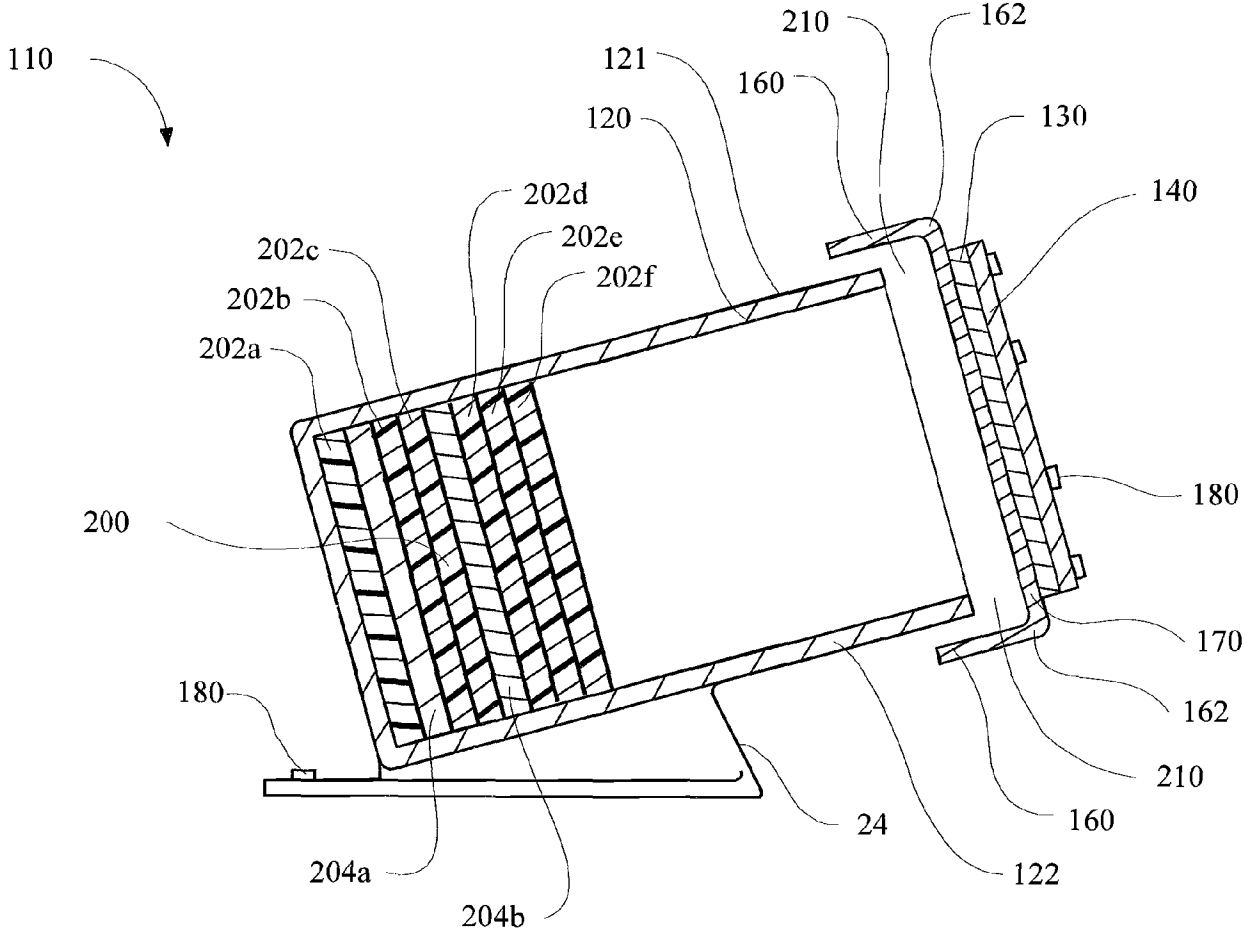
FIG. 3 shows a cross-sectional view of a clearing trap with a plurality of layers of bullet deceleration material in accordance with principles of the present invention.
Figure 5:
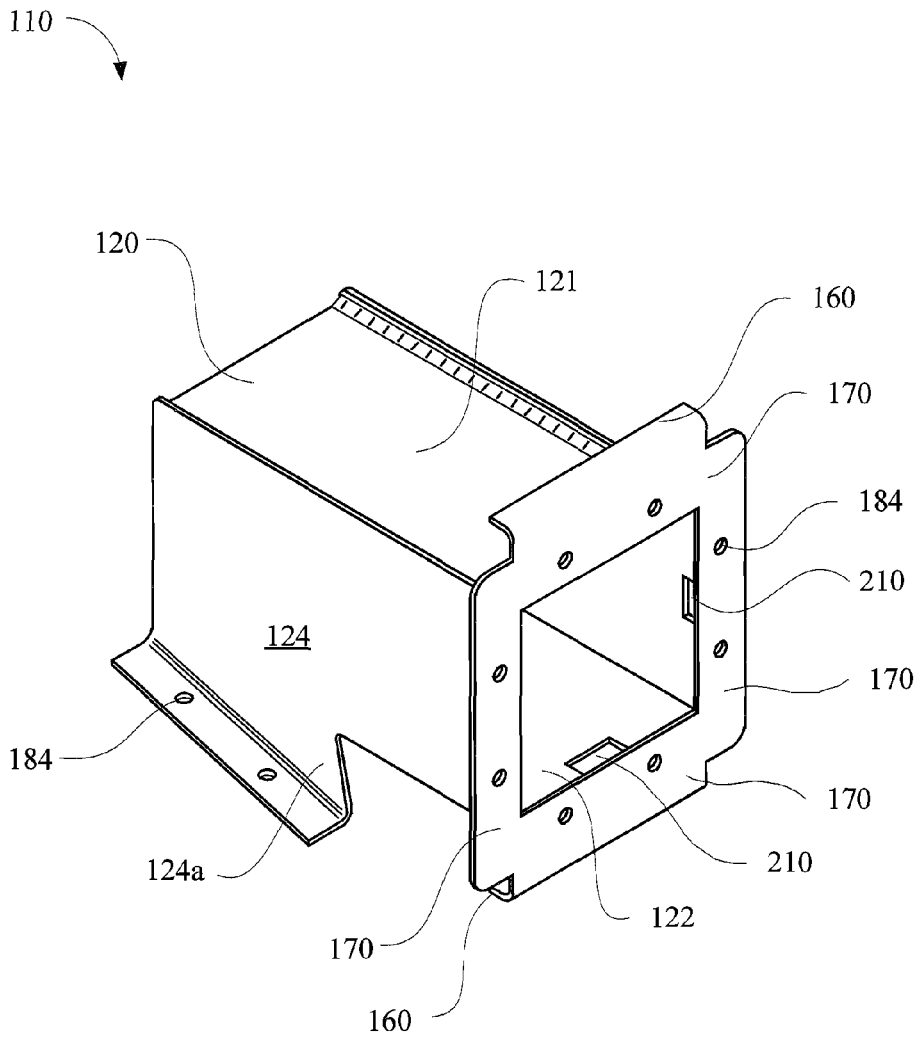
FIG. 5 shows a perspective view of the open end of a clearing trap with vent holes adjacent to the flanges of the housing.

Disposed in one or more of the sidewalls 124, the top wall 121 and the bottom wall 122, is one or more vents 210 (shown in more detail in FIGS. 3 and 5). In some prior art clearing traps, vents are provided to dissipate the gasses released with the firing of a round. For example, the vent holes in some prior art devices are simply cut or formed into the sides of the clearing trap. As gasses escape from the gun, they enter the clearing trap and a portion deflects off the deceleration material. Thus, some of the gas may be deflected back toward the person firing the gun, or toward people standing adjacent the clearing trap.

In accordance with one aspect of the present invention, the diverters 160, 164 ultimately extend from the housing and channel the vented gasses back along paths generally parallel to the path of travel of the bullet. Thus, the gasses are directed away from the shooter and those who may be standing adjacent the shooter when the gun discharges. This prevents the shooter and others from being hit by the vented gasses and any debris or particles that the vented gasses may carry.

Turning now to FIG. 3, there is shown a cross-sectional view of the clearing trap 110 with a plurality of layers of bullet deceleration material 200 disposed within the housing. The bullet deceleration material 200 may include a plurality of pieces of rubber 202*a-f*. (As used herein, "rubber" refers to natural rubber and other rubber-like materials, including but not limited to petroleum based polymers, other resilient synthetics, etc.) The plurality of pieces (or sheets) of rubber 202*a-f* may have different densities to provide for desired deceleration characteristics. Additionally, bullet deceleration material may include interspersed pieces of metal 204*a* and 204*b*. As a bullet is fired into the clearing trap 110, the bullet deceleration material 200 safely decelerates the bullet. If metal is included in the bullet deceleration material 200, soft steel may be used so that a bullet may penetrate one or more steel layers if necessary. However, it is generally desirable to have at least one piece of metal be hardened steel. Unlike the rubber which only slows the bullet, hardened steel, such as AR 500 will tend to cause the bullet to deflect and to fragment. The deflected fragments have less momentum and are then generally easier to stop either with the rubber and remaining steel or with the walls of the housing 120 because of the reduced inertia.

In accordance with the principles of the present invention, it has been found that it is preferred to have the final piece of metal be hardened steel that is at least between about ⅜ and ¼ of an inch thick, although thinner or thicker pieces can be used. Additionally, it has been found that it is preferable, though not required, to have at least one piece of rubber 202*a* disposed distally to the last piece of hardened steel 204*a*. As the bullet, or fragments thereof, hit the last piece of steel 204*a*, the rubber 202*a* compresses, making it harder to penetrate steel as the steel deflects in response to the impact.

The combination of hardened steel plates 204 and rubber 202 has achieved remarkable results. A housing 120 approximately 10 inches long was provided with three pieces of hardened steel interspaced between the rubber pieces, with total deceleration medium slightly less than 7 inches. A 50 caliber armor-piercing round was fired into the clearing trap 110 and was safely contained therein. Containing such a round is generally challenging even in a larger clearing trap.

While the trap can be configured to stop such a high powered round, it can also use fewer or thinner pieces of rubber 202*a-f* and metal 204*a-b* to stop smaller rounds if desired. For example, a small caliber handgun range may use thin pieces (¼-⅜ of an inch) and some soft steel, while a range which allows higher caliber weapons may use thicker pieces (⅜-1 inch) and/or more pieces, including hardened steel, to safely contain a broader range of bullets.

FIG. 3 also shows vent holes 210 formed in the top wall 121 and bottom wall 122 and the diverters 160 extending from the flange 170 for channeling the vented gasses, and anything which may be carried thereby, away from the shooter. Thus, the risk to the shooter of getting hit with gas-borne debris is virtually eliminated.

Figure 4:
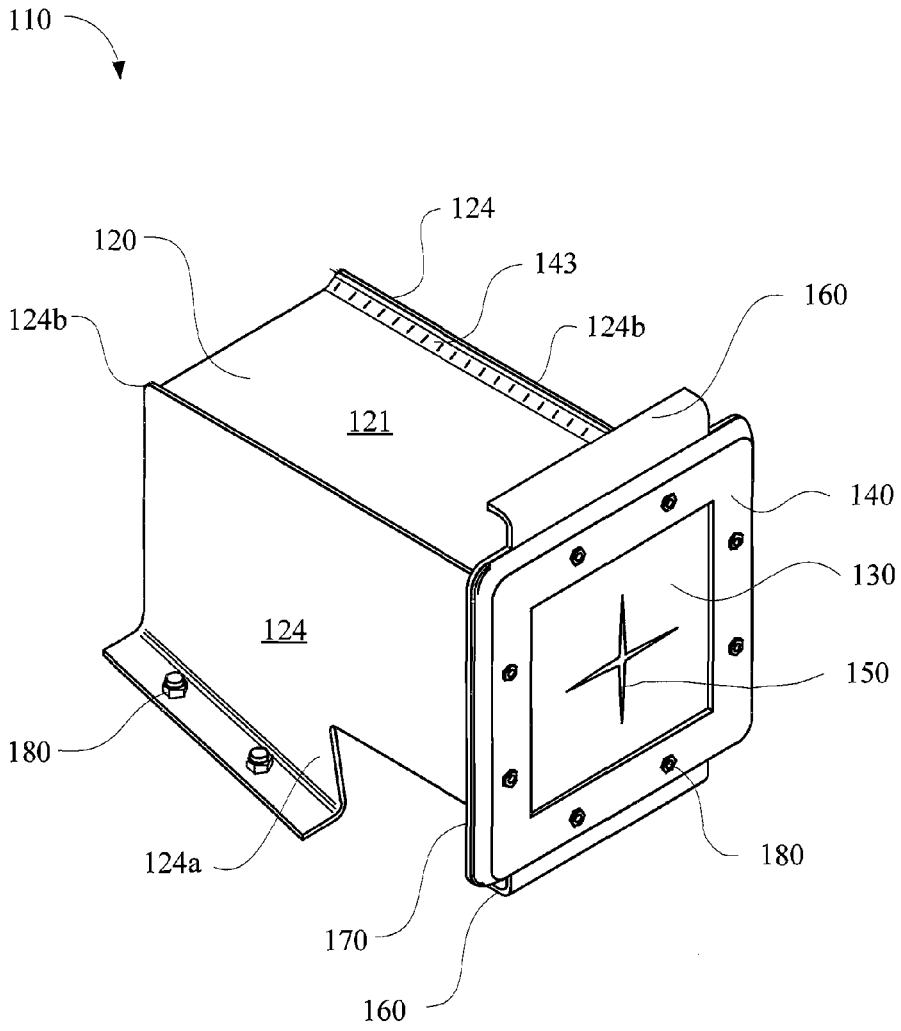
FIG. 4 shows a perspective view of a clearing trap of the present invention with a face plate removably connected to the housing.

Now turning to FIG. 4, there is shown a perspective view of the clearing trap 110 of the present invention with a containment shield 130 removably connected to the housing 120. The containment shield 130 may include an opening for receiving a firearm and may be removably connected to the clearing trap 110 between the flange 170 and front mount plate 140. The opening 150 in the containment shield 130 may be sufficiently large enough for receiving a variety of different sized firearms while being able to substantially prevent bullet fragments from passing back through the opening after a firearm discharges. The mounting plate 140 may be removably connected to the flange 170 using bolts 180. However, a variety of other fasteners may be used to removably connect the mounting plate 40 to the flange 170 or other structure on the housing 120 of the clearing trap 110.

To ensure that clearing trap 110 remains effective at decelerating bullets, the containment shield 130 and the mounting plate 140 can be removed to access the interior of housing 120. After several bullets have been discharged into the clearing trap 110 (or a single round in case of a high powered round such as an armor piercing 50 caliber round), the bullet deceleration material can become less effective at decelerating a bullet. However, the bullet deceleration material can be easily replaced in order to ensure the proper function of clearing trap 110. This is accomplished by simply detaching the mounting plate 140 and either detaching or bending the containment shield 130 out of the way and sliding out the metal and rubber pieces which form the deceleration material. New pieces of metal and rubber (or already present pieces of metal or rubber which are still in good shape) may then be placed into the housing 120 and the containment shield 130 and mounting plate 140 returned to the position shown in FIG. 4. In a manner of minutes, the clearing trap 110 is in like new condition and ready for use. This is in contrast to some prior art configurations, in which a portion of the housing is literally cut off to remove the deceleration material.

Additionally, the clearing trap 110 may be advantageous because it is relatively light weight. Unlike traps using sand as a deceleration material, the clearing trap 110 can be easily lifted and inverted so the deceleration materials slide out. Additionally, the light weight of the trap allows it to be used in a large number of situations, including truck or car mounted applications for police officers and the like.

FIG. 4 also shows in additional detail how the sidewalls 124 may extend and be bent to form the base 124A. One challenge with working with hardened steel is the difficulty in forming the steel into a box. In accordance with one aspect of the present invention, the housing 120 of the clearing trap 110 may be formed from multiple flat pieces of hardened steel. An overlap 124B is formed between the sidewalls 124 and the top wall 121. A weld 143 may be formed between the top of the top wall 121 and the overlapped portion of the sidewall 124. A similar weld may be formed between the top wall 121 and the sidewall 124 in the foreground in FIG. 4, but the overlap portion hides the weld from view.

Welding hardened steel is problematic because the weld can weaken the steel. However, in accordance with one aspect of the present invention, the weld itself is never exposed to a bullet entering the housing and the weld reinforces the portion of the hardened steel which has been heated during the welding process. (While FIG. 4 shows the overlap occurring on the sidewall, it will be appreciated that the top of the sidewall 124 could butt up against the top wall 121, with the top wall 121 overhanging.)

Now turning to FIG. 5, there is shown a perspective view of the open end of the clearing trap 110 with a vent hole 210 adjacent to the flange 170. As discussed above, containment shield 130 (FIG. 4) and the mounting plate 140 (FIG. 4) can be easily removed from the housing 120 to facilitate replacement of worn bullet deceleration material. The containment shield 130 may also be easily replaceable.

The vent hole 210 can be seen adjacent to the flange 170 in the lower wall 122. When a firearm is discharged inside the housing 120, the vent hole 210 facilitates release of the pressure generated by gasses passing from the firearm into the housing 120. An additional vent hole (not pictured) may be located adjacent to the flange 170 of upper wall 121 and/or vent holes 210 can be formed in the sidewalls 124.

Air flow and debris generated from the discharge of a firearm into the housing 120 and dissipated through vent holes 210, is safely directed away from the shooter by diverters 160 which may extend from upper and lower portions of the flange 170, and/or from the mounting plate 140 (not shown in FIG. 5) or other structures. As the gasses pass out of the vent holes, the diverters 160 prevent the gasses from traveling toward the person firing the firearm, and preferably channel the gasses back into a direction generally parallel with the travel path of the bullet. In this way, the shooter is not hit with any debris, such as fragments of rubber or small fragments of a bullet which may be carried by the gasses.

Figure 6:
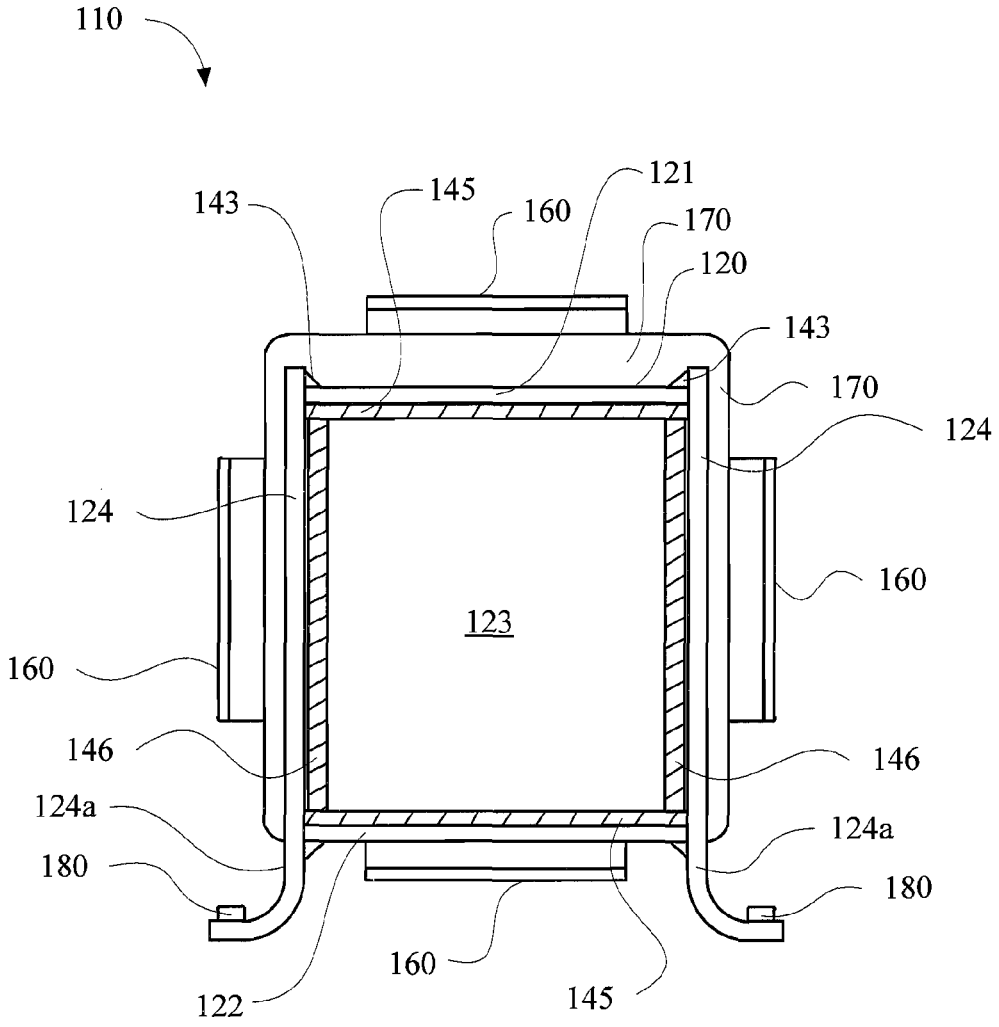
FIG. 6 shows a distal end view of a clearing trap of the present invention.

Turning now to FIG. 6, there is shown a view of the clearing trap 110 taken from a distal end of the housing 120. The housing 120 may be formed from a back wall or end plate 123. The back wall 123 may attach to the top wall 121 and to the bottom wall 122 by welds 145 As shown in FIG. 6, the top wall 121 and the bottom wall 122 each have an overlap and the welds 145 are formed between the outside surface of the back wall 123 and the inside surface of the overhang of the top and bottom plates. Those skilled in the art will appreciate that the attachment could be reversed if desired so that the outside of the top plate is welded to the front side of an overhanging portion of the back wall 123. In this manner the steel plates forming the housing are welded together but the weld is not directly exposed to a bullet in the housing 120.

The back wall 123 may also be attached to an overhang along each of the sidewalls 124 so that welds 146 are attached to the back of the back wall 123 and the inside of the overhanging portion of the sidewalls 124. It will be appreciated that the attachment could be reversed with the outside of the sidewalls 124 being attached to an overhanging portion of the back wall 123. Either way, the welds 145, 146 are not directly exposed to bullets fired into the housing 120.

FIG. 6 also shows how the sidewalls 124 may be bent so that a single piece of steel forms both the sidewall 124 and the base portion 124A. The diverters 160 used to channel gasses away from the person shooting the gun are also shown. The diverters 160 may be formed from a single piece of steel with either the flange 170 or the mounting plate 140, or both, or may be welded on or otherwise attached to either structure. Likewise, the diverters 160 could be attached directly to the housing 120.

Figure 7:
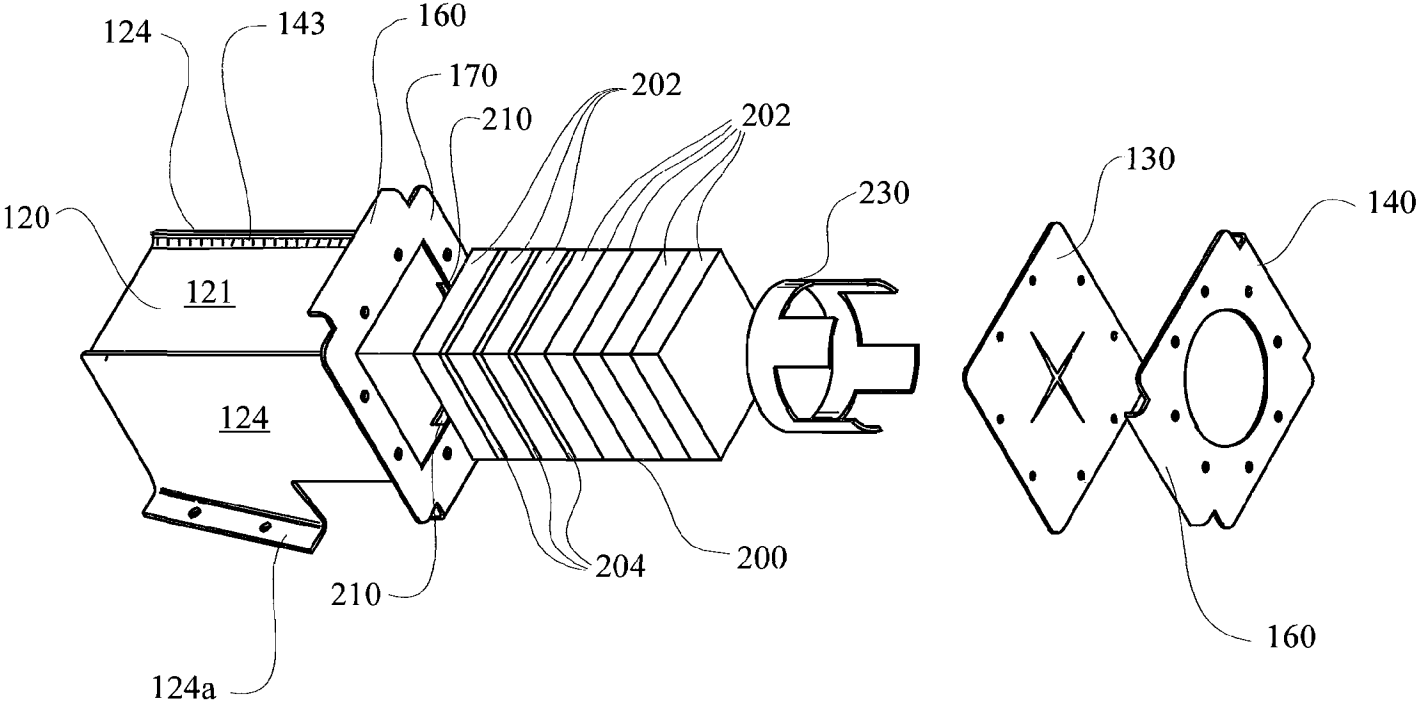
FIG. 7 shows an exploded view of a clearing trap in accordance with principles of the present invention including a retention insert for securing the deceleration material.

FIG. 7 shows an exploded view of a clearing trap 110 made in accordance with principles of the present invention. The deceleration material may be made up of five pieces or sheets of rubber 202, followed by a piece or sheet of metal 204. The sheet of metal 204 may be regular steel or, in some applications, preferably hardened steel and more preferably AR 500. Rubber 202 and metal 204 may then alternate with a piece of rubber being disposed behind the last piece of metal. As a bullet is fired into the deceleration material, the bullet will typically penetrate at least several layers of rubber. A 22 caliber round may only pass through two or three pieces of rubber before being stopped. A slightly larger handgun round may penetrate through the rubber until hitting a first piece of hardened steel, wherein the bullet may fragment or ricochet and either be stopped by the rubber or by one of the top wall 121, the bottom wall 122 or one or more of the sidewalls 124. In the alternative, a hand gun round may impact soft steel and either dent the steel or penetrate a first layer.

A higher velocity round, such as a .223 may penetrate the rubber 202 and the first piece of metal 204 only to be stopped by subsequent pieces of rubber or metal. Still other rounds, such as a 50 caliber armor piercing round may penetrate through all of the pieces of rubber and the metal up to the last metal piece, wherein it is stopped. If the round were to somehow pierce the last piece of metal, it would still have to pass through the last piece of rubber and then the backwall 123 of the housing 120.

By selecting the type of metal and the rubber used, a user of the clearing trap 110 may obtain the deceleration characteristics he or she desires. For example, with some high caliber rounds, it may be advantageous to have the bullet first impact a piece of soft (non-hardened) steel. The bullet will pierce the steel, but will lose a substantial amount of inertia in doing so. This reduces the risk of a ricochet while the bullet is still traveling at a high rate of speed. At the second piece of metal, a hardened steel piece of steel may be used. At this point a lower velocity bullet will tend to fragment against the steel and either be finally dissipated by the rubber or by the housing 120, while a higher velocity bullet may pierce the first hardened steel piece and then be fragmented by the second piece of hardened steel. By selecting the combination of rubber and soft and hardened steel, a person who runs a range or who is otherwise charged with clearing firearms can ensure that a desired deceleration pattern is obtained for the projectiles.

Some bullets may even be captured substantially whole for recycling, while others are fragmented to reduce the mass which must be stopped.

FIG. 7 also shows a retention member 230 which may be used to secure the deceleration material. When a high power round is fired into the deceleration material, the amount of reflected force is substantial. If the round is large enough, the pieces of rubber may be projected back toward the opening of the clearing trap 110. To prevent injury to the shooter, the retention member 230 inhibits the movement of the deceleration material toward the opening of the clearing trap. Typically this is done by having a body which can engage the deceleration material, such as a collar, which is larger in diameter than the opening in the mounting plate 140. The retention member 230 affirmatively prevents larger portions of the deceleration material from being thrown against the containment shield 130 and the mounting plate 140 and prevents the shooter from being pelted with pieces of rubber. This enables a very compact clearing trap 110 to decelerate a very powerful round, such as a 50 caliber armor piercing round in a very small space and with a relatively small weight.

Figure 8:
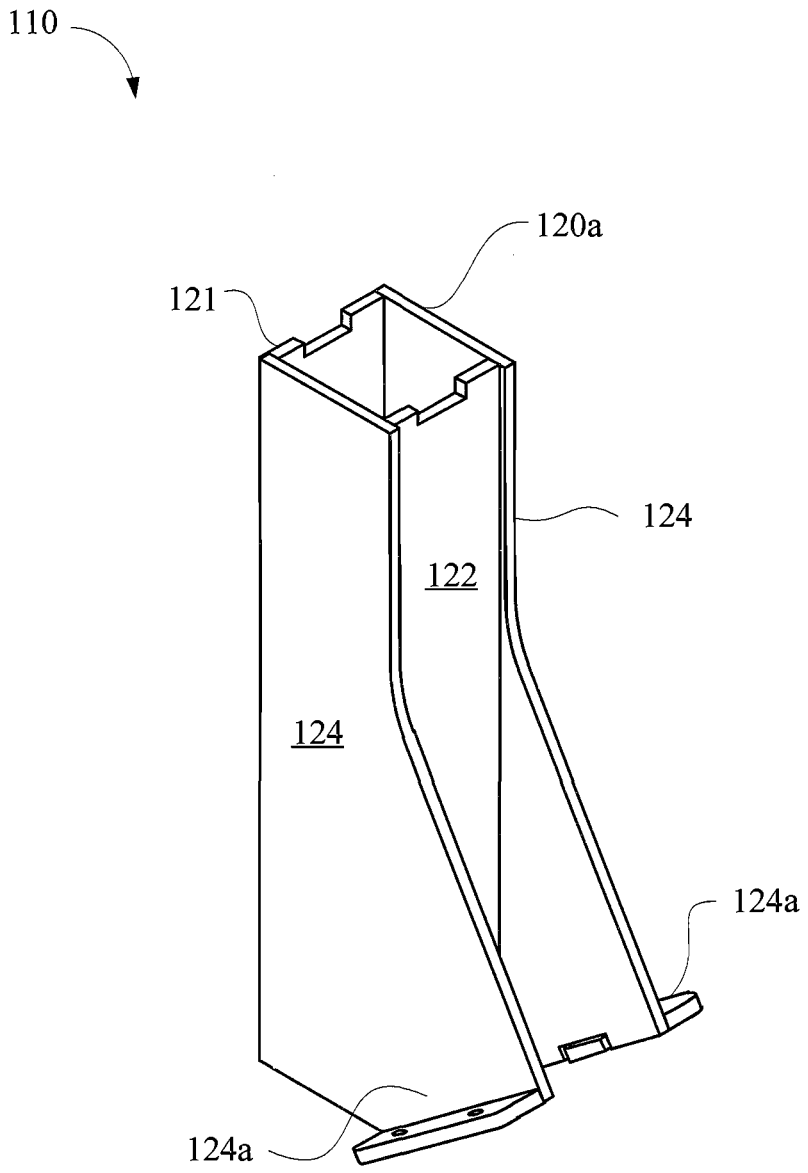
FIG. 8 shows an alternate embodiment of the housing for floor mounting.

FIG. 8 shows an alternate embodiment of the housing 120. Instead of being configured for sitting on a table or bench, the clearing trap 110 has a housing 120A which is designed for resting on the ground. The housing 120A is similar to housing 120 in that it may be formed by a top wall 121, a bottom wall 122 and sidewalls 124. The sidewalls 124 extend more lengthwise along the bottom wall 122 and are then bent at an angle to form the base portion 124A more perpendicular to the housing than generally parallel with the embodiment shown in FIGS. 2 through 7. This orientation, and a longer top wall, bottom wall and sidewalls 121, 122 and 124, makes the housing 120A extend a greater distance than housing 120 and makes the clearing trap 110 easier to use with rifles and the like. Additionally, because the housing is longer, more deceleration material may be used, reducing the frequency with which the deceleration material would need to be replaced due to discharged rounds. Additionally, as with the prior embodiment, making the top wall, bottom wall and sidewalls 121, 122 and 124 out of hardened steel (preferably AR 500) between ⅜ and ½ inch thick, enables the walls to channel or deflect a bullet into the deceleration material, even though the bullet was not fired at the correct angle, to thereby safely contain the bullet. In contrast, a trap made out of soft steel may bulge or even allow the bullet to penetrate the wall, potentially injuring the person clearing the gun or those nearby.

It will be appreciated that the housing 120A shown in FIG. 7 may be connected together with welds, such as discussed in detail with respect to FIG. 6. Other attachments could also be used. The housing 120A could be attached to a similar flange 170, containment shield 130, and mounting plate 140 as discussed above and may include vent holes and other structures as set forth above. For brevity, all of such structures will not be discussed again in detail.

It will be appreciated that various combinations of the aspects discussed above may be used consistent with the present invention. For example, a firearm clearing trap may include a housing having a cavity defined by an outer wall and at least one open end, the outer wall being formed by hardened steel; and a plurality of layers of bullet deceleration material, comprising at least one rubber layer and at least one metal layer. The clearing trap may also include: a) at least one rubber layer comprising a plurality of rubber layers disposed on opposing sides of the at least one metal layer; b) the at least one rubber layer comprising a plurality of rubber layers having different densities; c) the at least one rubber layer comprises a plurality of rubber layers and wherein the at least one metal layer comprises a plurality of metal layers; d) the plurality of metal layers being comprised of at least one layer of hardened steel; e) the plurality of metal layers comprising at least one layer of soft steel and at least one layer of hardened steel; f) at least one flange, a containment shield and a mounting plate for holding the containment shield to the at least one flange; g) at least one flange disposed adjacent a proximal end of the housing and at least one diverter extending from the flange and toward a distal end of the housing; h) at least one vent hole and wherein the diverter extends at least partially over the at least one vent hole; i) plurality of vent holes wherein a plurality of diverters extend from the at least one flange generally parallel to the housing to direct gasses passing out of the plurality of vent holes toward the distal end of the housing; j) a mounting plate attachable to the flange and wherein the mounting plate comprises at least one diverter positioned so as to at least partially extend over a vent hole in the housing; k) one vent hole is located in the housing substantially adjacent to a flange and the diverter extending along the housing to direct gasses passing out of the vent hole toward a distal end of the housing; and/or l) a retention insert for limiting movement of the deceleration material, or combinations thereof A method of forming a clearing trap may include selecting a housing having a cavity defined by an outer wall and at least one open end configured to receive a plurality of layers of bullet deceleration material, the housing being formed from hardened steel and disposing a plurality of layers of bullet deceleration material into the housing, at least one of the plurality of layers being metal and at least two of the plurality of layers being rubber material. The method may also include: a) selecting a plurality of rubber layers having different densities; b) at least one of the plurality of layers being metal which is hardened steel; c) at least one of the plurality of layers being metal being soft steel; d) selecting a housing with at least one vent hole; e) selecting a housing with a flange and a mounting plate attached thereto and at least one diverter extending from at least one of the flange and the mounting plate to cover the at least one vent hole and direct gas escaping from the at least one vent hole away from the flange and the mounting plate; and/or f) disposing a retention mechanism in the housing to limit movement of the deceleration material, or combinations thereof.

A clearing trap of the present invention may include a housing having an inside, an outside and an opening for receiving a firearm, and having a top wall, a bottom wall, a pair of sidewalls and a back wall, and wherein the back wall and the top wall abut one another so as to leave an overhang formed by a portion of the top wall or the back wall on the outside of the housing and a weld between an inner surface of the overhang and an outer surface of the back wall or top wall so as to form a weld on the outside of the housing which joins the top wall and back wall; and a bullet deceleration material.

The clearing trap may also include: a) a back wall which abuts the sidewalls and the bottom wall so as to leave overhangs and wherein the back wall is attached to the bottom wall and the sidewalls walls by one or more welds extending along the back wall and the bottom wall and sidewalls of the housing; b) an outer surface of the back wall is welded to overhangs formed by the sidewalls, the top wall and the bottom wall; c) sidewalls extending beyond the top wall and the bottom wall so as to form overhangs and wherein outer surfaces of the bottom wall and top wall are welded to the overhangs of the sidewalls; d) the sidewalls extending beyond the bottom wall and form a base portion for supporting the clearing trap; e) the bullet deceleration material comprising a plurality of layers of bullet deceleration material, at least one layer being a rubber material and at least one layer being hardened steel; and/or f) a retention member disposed in the housing to limit movement of the bullet deceleration material or any combination thereof.

A clearing trap of the present invention may include a housing having a void therein for receiving bullets and at least one vent hole for venting gasses discharged into the housing, the housing having a proximal end though which a bullet is fired and a distal end and at least one diverter connected to the housing for channeling gasses passing out of the vent holes toward the distal end of the housing.

The clearing trap may also include has a plurality of vent holes and a plurality of diverters wherein the plurality of diverters are disposed adjacent the plurality of vent holes to channel gasses passing out of the vent holes toward the distal end of the housing. There is thus disclosed an improved clearing trap for use with firearms. It will be appreciated that numerous changes may be made to the present invention without departing from the scope of the claims.

What is claimed is:

1. A firearm clearing trap, the firearm clearing trap comprising:

a housing having a cavity defined by an outer wall and at least one open end, the outer wall being formed by hardened steel; and a plurality of layers of bullet deceleration material disposed in the cavity, comprising at least one rubber layer and at least one metal layer, the at least one metal layer comprising at least one layer of soft steel and at least one layer of hardened steel.

2. The firearm clearing trap according to claim 1, wherein the at least one rubber layer comprises a plurality of rubber layers disposed on opposing sides of the at least one metal layer.

3. A firearm clearing trap, the firearm clearing trap comprising:

a housing having a cavity defined by an outer wall and at least one open end, the outer wall being formed by hardened steel; and a plurality of layers of bullet deceleration material, comprising at least one rubber layer and at least one metal layer; and wherein the at least one rubber layer comprises a plurality of rubber layers having different densities.

4. The firearm clearing trap according to claim 1, wherein the at least one rubber layer comprises a plurality of rubber layers and wherein the at least one metal layer comprises a plurality of metal layers.

5. The firearm clearing trap according to claim 1, wherein the housing further comprises at least one flange, a containment shield and a mounting plate for holding the containment shield to the at least one flange.

6. The firearm clearing trap of claim 1, wherein the housing further comprises at least one flange disposed adjacent a proximal end of the housing, at least one diverter extending from the flange and toward a distal end of the housing, and at least one vent hole formed in the outerwall substantially adjacent the flange such that gasses impacting the flange are directed out of the at least one vent hole.

7. The firearm clearing trap of claim 6, wherein the at least one vent hole is disposed at the proximal end of the outerwall and adjacent to and generally parallel with the flange so that no obstruction is formed between the flange and the at least one vent hole and wherein the diverter extends at least partially over the at least one vent hole.

8. The firearm clearing trap of claim 7, wherein the housing comprises a plurality of vent holes and wherein a plurality of diverters extend from the at least one flange generally parallel to the housing to direct gasses passing out of the plurality of vent holes toward the distal end of the housing.

9. The firearm clearing trap of claim 6, further comprising a mounting plate attachable to the flange and wherein the mounting plate comprises at least one diverter positioned so as to at least partially extend over a vent hole in the housing.

10. The firearm clearing trap according to claim 6, wherein the at least one vent hole is located in the housing substantially adjacent to a flange and wherein the diverter extends along the housing to direct gasses passing out of the vent hole toward a distal end of the housing.

11. The firearm clearing trap according to claim 1, the housing having a proximal end into which a firearm is inserted and the plurality of layers of deceleration material having a proximal most layer and further comprising a retention insert for limiting movement of the deceleration material, the retention insert being disposed between the proximal most layer and the proximal end of the housing.

12. A method for forming a clearing trap, the method comprising:

selecting a housing having a cavity defined by an outer wall and at least one open end configured to receive a plurality of layers of bullet deceleration material, the housing being formed from hardened steel; and disposing a plurality of layers of bullet deceleration material into the housing, at least one of the plurality of layers being metal and at least two of the plurality of layers being rubber material having different densities.

13. The method for forming a clearing trap according to claim 12, wherein the at least one of the plurality of layers being metal is hardened steel.

14. The method for forming a clearing trap according to claim 12, wherein the plurality of layers of bullet deceleration material are removably disposed into the housing and wherein the at least one of the plurality of layers being metal is soft steel.

15. The method for forming a clearing trap according to claim 12, wherein the method further comprises selecting a housing with at least one vent hole.

16. The method for forming a clearing trap according to claim 15, wherein the method further comprises selecting a housing with a flange and a mounting plate attached thereto and at least one diverter extending from at least one of the flange and the mounting plate to cover the at least one vent hole and direct gas escaping from the at least one vent hole away from the flange and the mounting plate.

17. The method for forming a clearing trap according to claim 12, wherein the method further comprises disposing a retention mechanism in the housing between a proximal end of the housing and a proximal end of the plurality of layers of bullet deceleration material to limit movement of the deceleration material.

18. A clearing trap comprising:

a housing having an inside, an outside and an opening for receiving a firearm, and having a top wall, a bottom wall, a pair of sidewalls and a back wall, and wherein the back wall and the top wall abut one another so as to leave an overhang formed by a portion of the top wall or the back wall on the outside of the housing and a weld between an inner surface of the overhang and an outer surface of the back wall or top wall so as to form a weld on the outside of the housing which joins the top wall and back wall; and bullet deceleration material removably disposed in the housing, wherein the bullet deceleration material comprises a plurality of layers of rubber having different densities and at least one layer of metal.

19. A clearing trap according to claim 18, wherein the back wall abuts the sidewalls and the bottom wall so as to leave overhangs and wherein the back wall is attached to the bottom wall and the sidewalls walls by one or more welds extending along the back wall and the bottom wall and sidewalls of the housing.

20. The clearing trap according to claim 19, wherein an outer surface of the back wall is welded to overhangs formed by the sidewalls, the top wall and the bottom wall.

21. The clearing trap according to claim 18, wherein the sidewalls extend beyond the top wall and the bottom wall so as to form overhangs and wherein outer surfaces of the bottom wall and top wall are welded to the overhangs of the sidewalls.

22. The clearing trap according to claim 18, wherein the sidewalls extend beyond the bottom wall and form a base portion for supporting the clearing trap.

23. The clearing trap according to claim 18, wherein the at least one layer of metal comprises hardened steel.

24. The clearing trap according to claim 18, further comprising a retention member disposed in the housing to limit movement of the bullet deceleration material.

25. A clearing trap comprising:

a housing having a single layer outer wall extending along a length of the housing, the single layer outer wall defining a void therein for receiving bullets, the single layer outer wall deflecting bullets back into the void and at least one vent hole formed in the single exterior wall for venting gasses discharged into the housing, the housing having a proximal end though which a bullet is fired and a distal end;

at least one diverter connected to the housing for channeling gasses passing out of the vent holes toward the distal end of the housing; and deceleration material removably disposed in the void, the deceleration material comprising a plurality of layers, at least one layer being rubber, at least one layer being soft steel and at least one layer being hardened steel.

26. The clearing trap of claim 25, wherein the housing has a plurality of vent holes and a plurality of diverters and wherein the plurality of diverters are disposed adjacent the plurality of vent holes to channel gasses passing out of the vent holes toward the distal end of the housing.

27. The clearing trap of claim 25, wherein the void defined by the single layer outer wall has a cross-sectional area and wherein the cross-sectional area remains substantially the same from the proximal end of the housing to the distal end of the housing.

* * * * *